United States Patent [19]

Lawson

[11] Patent Number: 4,610,144

[45] Date of Patent: Sep. 9, 1986

[54] COOLING OF METAL STRIP

[75] Inventor: Kenneth T. Lawson, Hathersage, Nr. Sheffield, England

[73] Assignee: Davy McKee (Sheffield) Limited, Yorkshire, England

[21] Appl. No.: 775,405

[22] Filed: Sep. 12, 1985

[30] Foreign Application Priority Data

Sep. 14, 1984 [GB] United Kingdom ..... 8423235

[51] Int. Cl.[4] ..... F25D 13/06

[52] U.S. Cl. ..... 62/63; 62/64; 62/374; 118/314; 118/315; 134/64 R; 134/122 R

[58] Field of Search ..... 62/63, 64, 374, 375; 118/314, 315, 324; 134/122 R, 64 R

[56] References Cited

U.S. PATENT DOCUMENTS

| | | | |
|---|---|---|---|
| 2,581,957 | 1/1952 | Jones | 118/315 |
| 2,762,149 | 9/1956 | Mears | 118/314 |
| 2,940,458 | 6/1960 | Speckman | 62/374 |
| 3,835,764 | 9/1974 | Londahl et al. | 62/374 |
| 4,325,221 | 4/1982 | Grewar | 62/63 |
| 4,414,825 | 11/1983 | Gittelbaurer | 62/374 |

*Primary Examiner*—Ronald C. Capossela

*Attorney, Agent, or Firm*—Lee, Smith & Zickert

[57] ABSTRACT

When cooling hot metal strip, it is known to employ headers which apply continuous curtains of water across the width of the strip. The headers above the strip are inclined to each other so that the curtains extend across the width of the strip and are spaced apart horizontally by a greater distance at one edge of the strip than at the other edge.

6 Claims, 3 Drawing Figures

COOLING OF METAL STRIP

Hot metal strip produced in a rolling mill is cooled on a run-out table by having a liquid coolant, usually water, applied to it. It is known for the coolant to be applied in the form of a number of continuous curtains, each of which extends from one edge of the strip to the other. It is usual for these curtains to extend in mutually parallel relation at right angles to the direction of movement of the strip. Curtains are usually applied to both the upper and the lower surface of the strip but, with such a known arrangement and with high flow rates, an appreciable amount of water builds up on the upper surface of the strip and this has an effect on the way the strip is cooled. Particularly where water introduced on to the surface of the strip from one curtain meets water introduced on to the surface of the strip from the adjacent curtain, eddies can form where the two opposing streams meet and this means that there is an unstable and non-uniform cooling pattern applied to the upper surface of the strip.

This is an unsatisfactory situation and it is an object of the present invention to improve on this unsatisfactory situation.

According to a first aspect of the present invention, apparatus for cooling hot metal strip moving substantially horizontal in the direction of its length comprises a structure, a pair of headers supported by the structure above the path taken by the strip, means for supplying liquid coolant to the headers and each header being arranged to supply a continuous curtain of coolant across the path taken by the strip, the dimensions of the headers and the position of the headers being such that, in use, each header applies a curtain of liquid coolant to the upper surface of the strip from one edge of the strip to the other and the curtains are inclined to each other so that at one edge of the strip the curtains are spaced apart horizontally by a greater distance than at the other edge of the strip.

One of the headers may be positioned such that, in use, the curtain is at right angles to the path taken by the strip, but the other header is positioned such that, in use, the curtain is inclined to the path taken by the strip by a small angle of, say, 10°-20°, although both headers may be at an angle which is other than a right angle to the direction of movement of the strip.

The reason for inclining the two curtains is that the water on the surface of the strip from one curtain which meets the water on the surface of the strip from the other curtain has a sideways component which causes the water to move sideways on the surface of the strip and flow over one edge of the strip. This prevents a build up of water on the surface of the strip and cooling of the strip is more uniform.

According to a second aspect of the present invention, in a method of cooling hot metal strip moving substantially horizontal in the direction of its length, two curtains of liquid coolant are applied to the upper surface of the strip with each curtain extending from one edge of the strip to the other, and with the curtains inclined to each other so that at one edge of the strip the curtains are spaced apart horizontally by a greater distance than at the other edge of the strip.

In a preferred arrangement, there are three water curtains applied to the upper surface of the strip. Each curtain extends from one edge of the strip to the other and the curtains are spaced apart in the direction of length of the strip. The two outer curtains are arranged parallel and each inclined by an angle other than 90° to the length of the strip. The central curtain of the three curtains is inclined in the opposite direction by an an angle other than a right angle to the length of the strip. In this way, one pair of adjacent curtains converge towards one edge of the strip and the other pair of adjacent curtains converge towards the other edge of the strip and, in this way, water flows off both edges of the strip.

Some of the water applied to the upper surface of the strip from the curtain which is the most downstream curtain of the group of curtains will remain on the surface of the strip on the downstream side of the curtain, but means can be applied to the strip to cause this water to be blown off one edge of the strip.

In order that the invention may be more readily understood, it will now be described, by way of example only, with reference to the accompanying drawing, in which.

Figure 1:
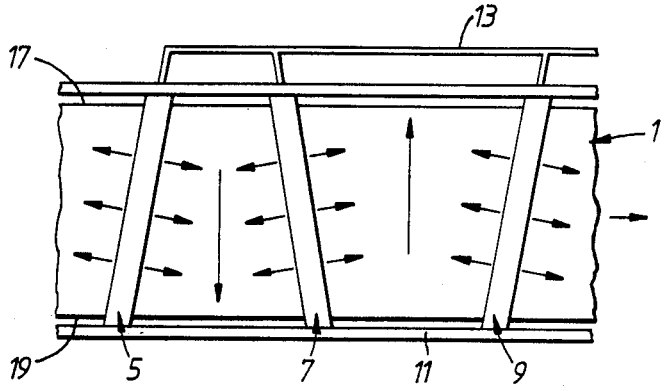
FIG. 1 is a diagrammatic plan view of apparatus in accordance with the invention.

A hot metal strip 1 is moving substantially horizontal in the direction of its length on a run-out table 3. Means may be provided to apply coolant to the underside of the strip on the run-out table, but this is not shown in the figures.

Headers 5, 7 and 9 are positioned above the run-out table 3 and are rigidly supported on a gantry 11. Liquid coolant, conveniently water, is supplied to the headers by way of a feed pipe indicated by reference 13.

In use, each header is arranged to apply a continuous curtain 15 of liquid coolant to the upper surface of the strip.

The curtains 15 produced by the headers 5, 7 are inclined to each other so that at the edge 17 of the strip the curtains are spaced apart horizontally by a smaller distance than they are at the edge 19 of the strip. In this way, water collecting on the surface of the strip, as indicated by the arrows, has a component of movement towards the edge 19 of the strip and the water is directed towards and flows over the edge of the strip.

The further header 9 is located downstream of the headers 5, 7 and this header is also inclined to the adjacent header 7 so that the space between the curtains 15 produced by the headers 7, 9 at the edge 17 of the strip is greater than the distance between the curtains at the edge 19 of the strip. In this way, water collecting on the surface of the strip has a component of movement towards the edge 17 and the water flows over the edge of the strip.

Figure 2:
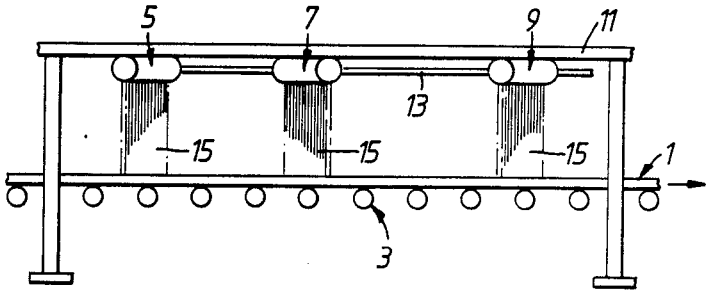
FIG. 2 is a diagrammatic side elevation.

Although only three headers are shown in FIGS. 1 and 2, it will be appreciated that four or more curtains can be and usually are employed.

Figure 3:
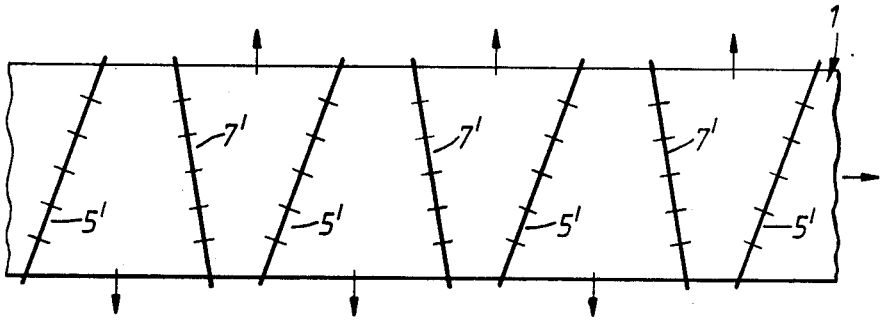
FIG. 3 is a diagrammatic plan of a multicurtain installation.

In the arrangement of FIG. 3, a multiplicity of first headers 5' are arranged in substantially parallel spaced apart relation along the length of the run-out table. The headers are inclined to the direction of the length of the strip 1 by an angle of, say, 10°-20°. A further multiplicity of headers 7' are arranged in parallel spaced apart relation and the headers 7' are interdigitated with the headers 5'. The headers 7' are also inclined to the direction of the length of the strip by an angle of, say, 10°-20°. Water discharged on to the strip by water curtains emitted by the headers flows off opposite edges of the strip where the separation of adjacent headers is greatest.

Downstream of the header 9, a certain amount of water will tend to remain for a longer period of time on the upper surface of the strip but air under pressure could be directed on to the surface of the strip to force the excess water to flow over the edges of the strip. Alternatively, pinch rolls or damming rolls can be used to prevent the water being carried further by the strip.

By ensuring that excess water does not remain on the surface of the strip, and also by ensuring that water applied to the surface from one water curtain does not form eddies with water applied to the surface by the adjacent water curtain, more efficient and uniform cooling of the strip results.

What I claim as my invention and desire to secure by Letters Patent is:

1. A method of cooling hot metal strip moving substantially horizontal in the direction of its length in which two curtains of liquid coolant are applied onto the upper surface of the strip with each curtain extending from one edge of the strip to the other, and with the curtains inclined to each other so that at one edge of the strip the curtains are spaced apart horizontally by a greater distance than at the other edge of the strip and where coolant on the upper surface of the strip between the curtains flows to that edge of the strip where the separation of the curtain is greatest.

2. Apparatus for cooling hot metal strip moving substantially horizontal in the direction of its length, said apparatus comprising a structure, a pair of headers supported by the structure above the path taken by the strip, means for supplying liquid coolant to the headers, each header being arranged to supply a continuous curtain of coolant across the full width of the path taken by the strip, and the headers being inclined to each other so that, in use, at one edge of the strip the curtains are spaced apart horizontally by a greater distance than at the other edge of the strip and coolant on the upper surface of the strip between the curtains flows to that edge of the strip where the separation of the curtains is greatest.

3. Apparatus as claimed in claim 2, in which both headers are positioned such that, in use, the curtains of liquid coolant issuing therefrom are inclined to the path taken by the strip.

4. Apparatus as claimed in claim 2, in which the structure supports a further header above the path taken by the strip, said header having means for supplying liquid coolant thereto and being arranged to apply a continuous curtain of coolant across the full width of the path taken by the strip downstream of the other two curtains, the dimensions of the further header and its position being such that, in use, it applies a curtain of liquid coolant to the upper surface of the strip from one edge of the strip to the other and the curtain is inclined to the adjacent curtain upstream thereof so that at one edge of the strip the further curtain and the curtain adjacent thereto are spaced apart horizontally by a greater distance than at the other edge of the strip.

5. Apparatus as claimed in claim 4, in which the curtain provided by the further header and the curtain immediately upstream thereof converge towards one edge of the strip and said upstream curtain and the other curtain upstream thereof converge towards the other edge of the strip.

6. Apparatus as claimed in claim 5, in which there are a multiplicity of headers arranged in parallel spaced apart relation and inclined to the path taken by the strip and a further multiplicity of headers arranged in parallel spaced apart relation and inclined to the path taken by the strip, the headers being interdigitated so that adjacent headers are closer to each other at one edge of the strip than at the other edge.

* * * * *